US005769322A

United States Patent [19]

Smith

[11] Patent Number: 5,769,322

[45] Date of Patent: Jun. 23, 1998

[54] ROTARY SPRINKLER AND BASE

[75] Inventor: Jeffrey L. Smith, Latrobe, Pa.

[73] Assignee: Gilmour, Inc., Newark, Del.

[21] Appl. No.: 499,318

[22] Filed: Jul. 7, 1995

[51] Int. Cl.[6] ..... B05B 3/04; B05B 3/08

[52] U.S. Cl. ..... 239/236

[58] Field of Search ..... 239/225.1, 231, 239/236, 240, 237, 251, 255, 261, 263.3, 264, 265, 279, 461, 505, 507, 513, 514, 515, 248, 566, 567, 276, 280.5; 248/80, 188.6, 346.3

[56] References Cited

U.S. PATENT DOCUMENTS

| | | | |
|---|---|---|---|
| D. 191,158 | 8/1961 | Beinert | D91/1 |
| D. 196,094 | 8/1963 | Fee et al. | D91/1 |
| 1,102,354 | 7/1914 | Pougnet . | |
| 1,308,371 | 7/1919 | Roach | 239/237 X |
| 1,539,189 | 5/1925 | Holland | 239/240 X |
| 2,067,044 | 1/1937 | Corley | 239/276 X |
| 2,068,718 | 1/1937 | Thompson | 239/276 |
| 2,571,768 | 10/1951 | Schlonau et al. | 239/513 |
| 2,884,202 | 4/1959 | Smith . | |
| 3,143,297 | 8/1964 | Jepson | 239/313 |
| 3,878,990 | 4/1975 | Geraudie | 239/236 |
| 3,921,912 | 11/1975 | Hayes | 239/242 |
| 4,278,101 | 7/1981 | Tanaka et al. | 239/248 |
| 4,421,276 | 12/1983 | Rodgers | 239/273 |
| 4,540,125 | 9/1985 | Gorney et al. | 239/232 |
| 4,784,325 | 11/1988 | Walker . | |
| 5,115,977 | 5/1992 | Alkalay et al. | 239/68 |
| 5,299,742 | 4/1994 | Han | 239/206 |
| 5,330,103 | 7/1994 | Eckstein | 239/242 |
| 5,381,960 | 1/1995 | Sullivan et al. | 239/222.21 |

FOREIGN PATENT DOCUMENTS

| | | | |
|---|---|---|---|
| 1009448 | 5/1952 | France | 239/280.5 |
| 2031370 | 11/1970 | France . | |
| 1181972 | 11/1964 | Germany . | |
| 2412748 | 12/1995 | Germany . | |
| 6261 | 12/1897 | Norway | 248/190 |
| 964808 | 7/1964 | United Kingdom . | |

*Primary Examiner*—Andres Kashnikow
*Assistant Examiner*—Robin O. Evans
*Attorney, Agent, or Firm*—Middleton & Reutlinger; James C. Eaves, Jr.

[57] ABSTRACT

A rotary sprinkler and sled base. The sled base has a main body with a pair of wings pivotally connected thereto at opposed sides. The wings permit compact storage when folded in and provide a wider footprint when folded out to make the sprinkler more stable. The sprinkler head has a water channel which permits the jets to be lower to the ground for increased sprinkler stability. The sprinkler has a plurality of different sized vertical jets to achieve a more uniform water distribution, the top jet spraying further from the sprinkler, the bottom jet spraying the closest. The sprinkler has deflection means. The deflector may be a manually adjustable to fix the maximum spray distance or the deflector may be connected to a cam follower which follows a deformable circular "roller coaster" cam surface to alter the maximum spray distance as the sprinkler rotates. The deflector assembly may also include means for reducing water flow to the all of the jets.

15 Claims, 19 Drawing Sheets

ROTARY SPRINKLER AND BASE

BACKGROUND OF THE INVENTION

1. Field of the Invention

The present invention relates to a rotary sprinkler and base. The base has wings pivotally connected thereto to permit compact storage when folded in and provide a wider footprint when folded out. The sprinkler head has a water channel which permits the jets to be lower to the ground for increased sprinkler stability. The sprinkler has a plurality of different sized vertical jets to achieve a more uniform water distribution. The sprinkler has deflection means which may include means for reducing water flow to the jets.

2. Description of the prior Art

U.S. Pat. No. 5,381,960, to Sullivan et al., teaches an irrigation sprinkler head wherein a water pipe 11 has a U-shaped pipe extending therefrom with a rotating sprinkler head connected thereto. U.S. Pat. No. 5,330,103, to Eckstein, teaches a reversing rotary drive sprinkler having the water outlet atop the sprinkler drive. U.S. Pat. No. 5,299,742, to Han, teaches an irrigation sprinkler having a large volume water spray nozzle outlet 20 with a spreader nozzle outlet 22 therebelow.

U.S. Pat. No. 5,115,977, to Alkalay et al., teaches a gear driven rotary sprinkler having a nozzle 54 atop the gear drive assembly. U.S. Pat. No. 4,540,125, to Gorney et al., teaches a rotary sprinkler which can produce a non-circular spray pattern. U.S. Pat. No. 4,421,276, to Rodgers, teaches a convertible sprinkler having a pair of hinged paddles 16, 18, which fold together for hand holding or which unfold for ground support.

U.S. Pat. No. 3,921,912, to Hayes, teaches a rotary lawn sprinkler with an adjustable nozzle at its top portion. U.S. Pat. No. 3,878,990, to Geraudie, teaches a water sprinkler having a circular cam surface and cam follower which actuates a valve stem which extends into the sprinkler nozzle to modify the strength of the water jet. U.S. Pat. No. 1,102,354, to pougnet, teaches a large area agricultural watering apparatus having a plurality of nozzles of different sizes and inclinations, one set of nozzles pointed to one side of a carriage and one set pointed to the other side of the carriage.

U.S. Pat. No. Des. 196,094, to Fee et al., teaches a lawn sprinkler having an angularly downward extending tube having what appear to be three openings therein. U.S. Pat. No. Des. 191,158, to Beinert, teaches a lawn sprinkler having a water deflector at the nozzle outlet.

SUMMARY OF THE INVENTION

The present invention is for a rotary sprinkler and sled base. The sled base has a main body with a pair of wings pivotally connected thereto at opposed sides. The wings permit compact storage when folded in and provide a wider footprint when folded out to make the sprinkler more stable. The sprinkler head has a water channel which permits the jets to be lower to the ground for increased sprinkler stability. The sprinkler has a plurality of different sized vertical jets to achieve a more uniform water distribution, the top jet spraying further from the sprinkler, the bottom jet spraying the closest. The sprinkler has deflection means. The deflector may be a manually adjustable to fix the maximum spray distance or the deflector may be connected to a cam follower which follows a deformable circular "roller coaster" cam surface to alter the maximum spray distance as the sprinkler rotates. The deflector assembly may also include means for reducing water flow to the all of the jets.

More particularly, the present invention comprises a sprinkler having a base having a main body, the main body having means for connecting a sprinkler head assembly thereto, the connecting means being in water flow communication with a main body water channel, the main body having a first side and an opposed second side; the base further having a first wing and a second wing, the first wing being pivotally connected to the first side and the second wing being pivotally connected to the second side, where the first wing and the second wing can be pivoted between a first orientation folded underneath the main body for storage and a second orientation extending outward from the main body in a coplanar relationship for operational use; and, a sprinkler head assembly, the sprinkler head assembly being connected to the means for connecting a sprinkler head assembly thereto and in water flow communication therewith, the sprinkler head assembly including means for rotating the sprinkler head assembly, the rotating means having a top water exit therefrom, the sprinkler head assembly having at least one water jet, the at least one water jet being at a location vertically below the top water exit, the at least one water jet and the top water exit having a low water channel therebetween.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 21:
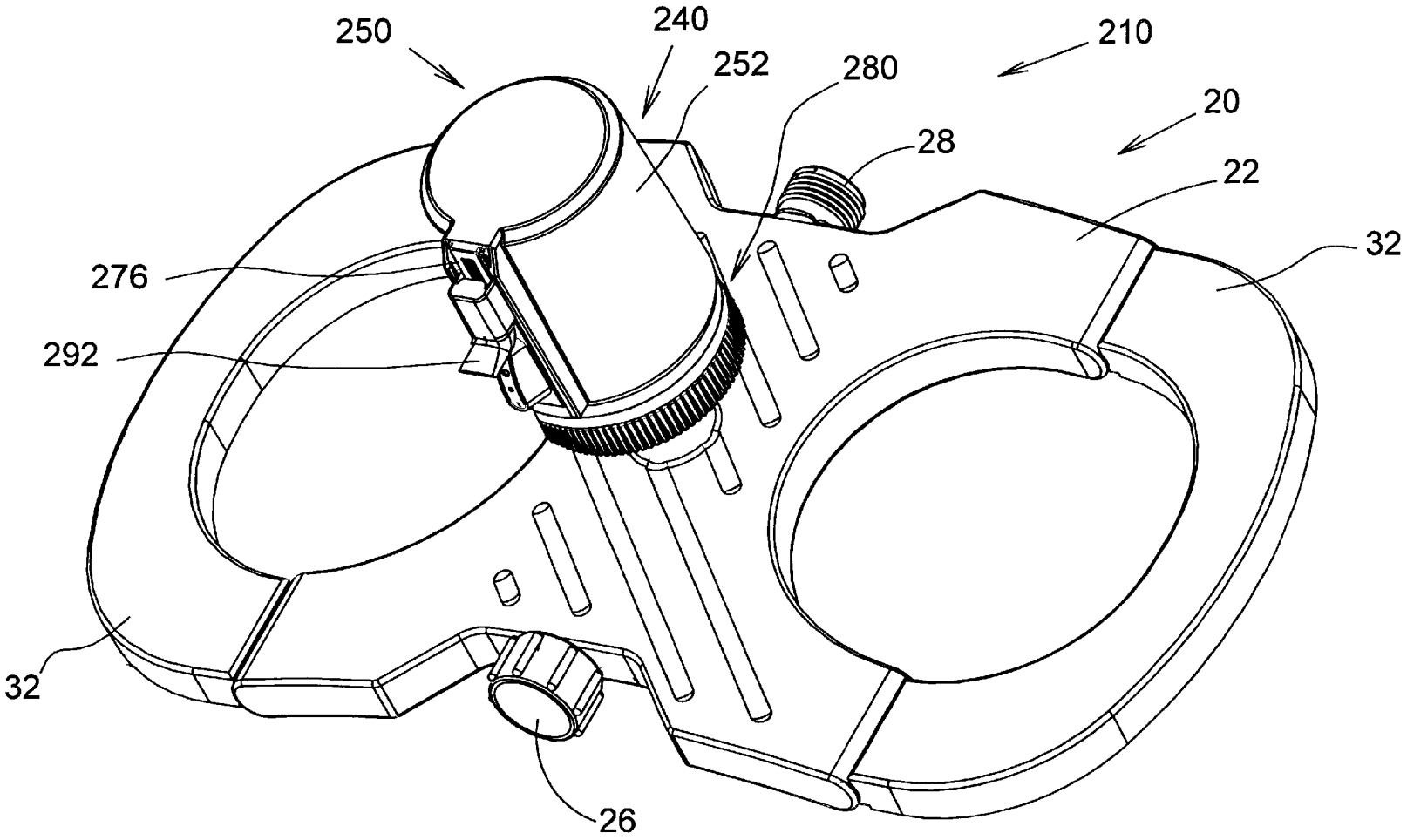
FIG. 21 is a perspective view of the sled base of FIGS. 15–20 having an alternative sprinkler head thereon.
Figure 22:
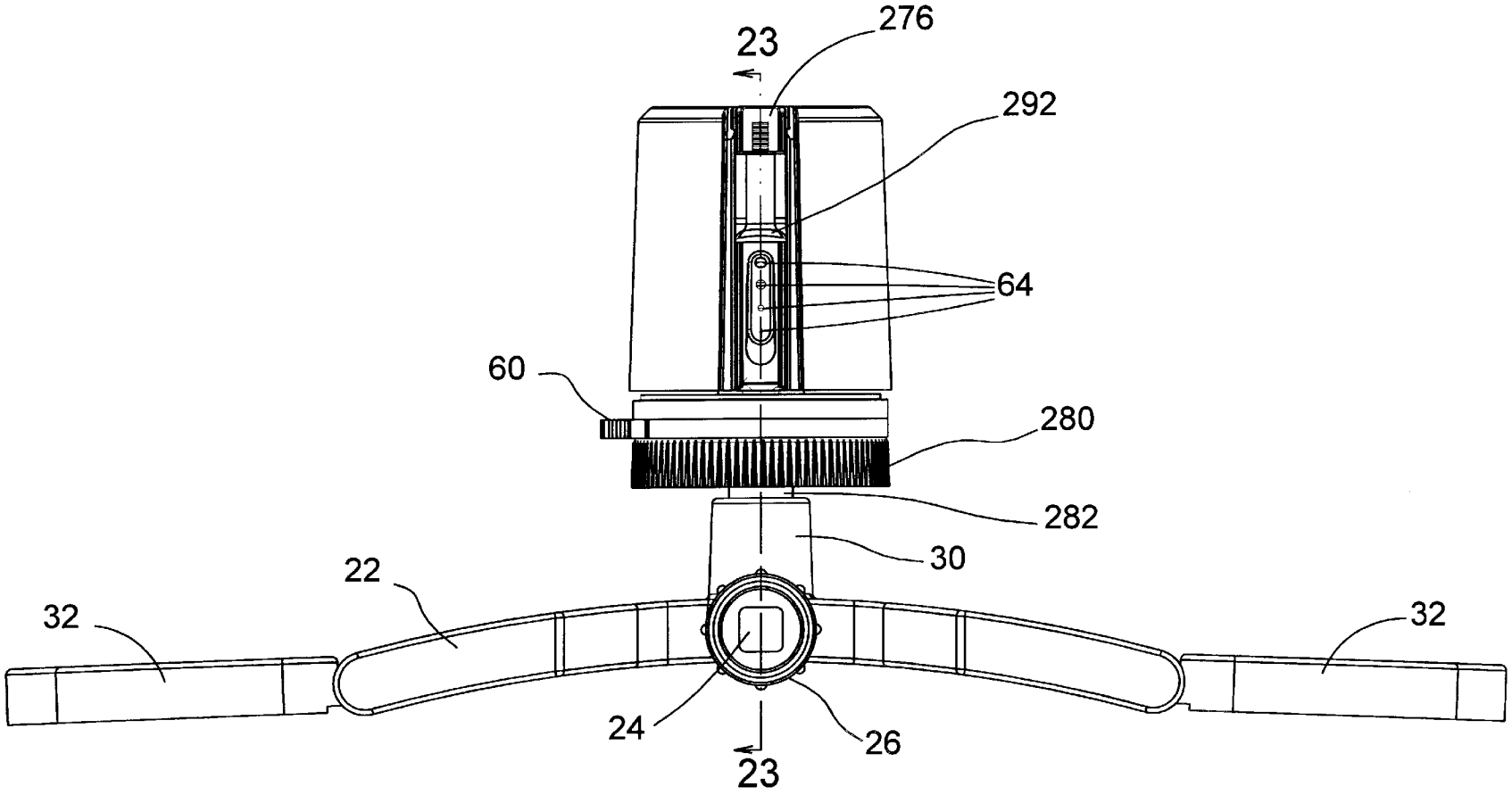
FIG. 22 is a front view of the sprinkler of FIG. 21.
Figure 23:
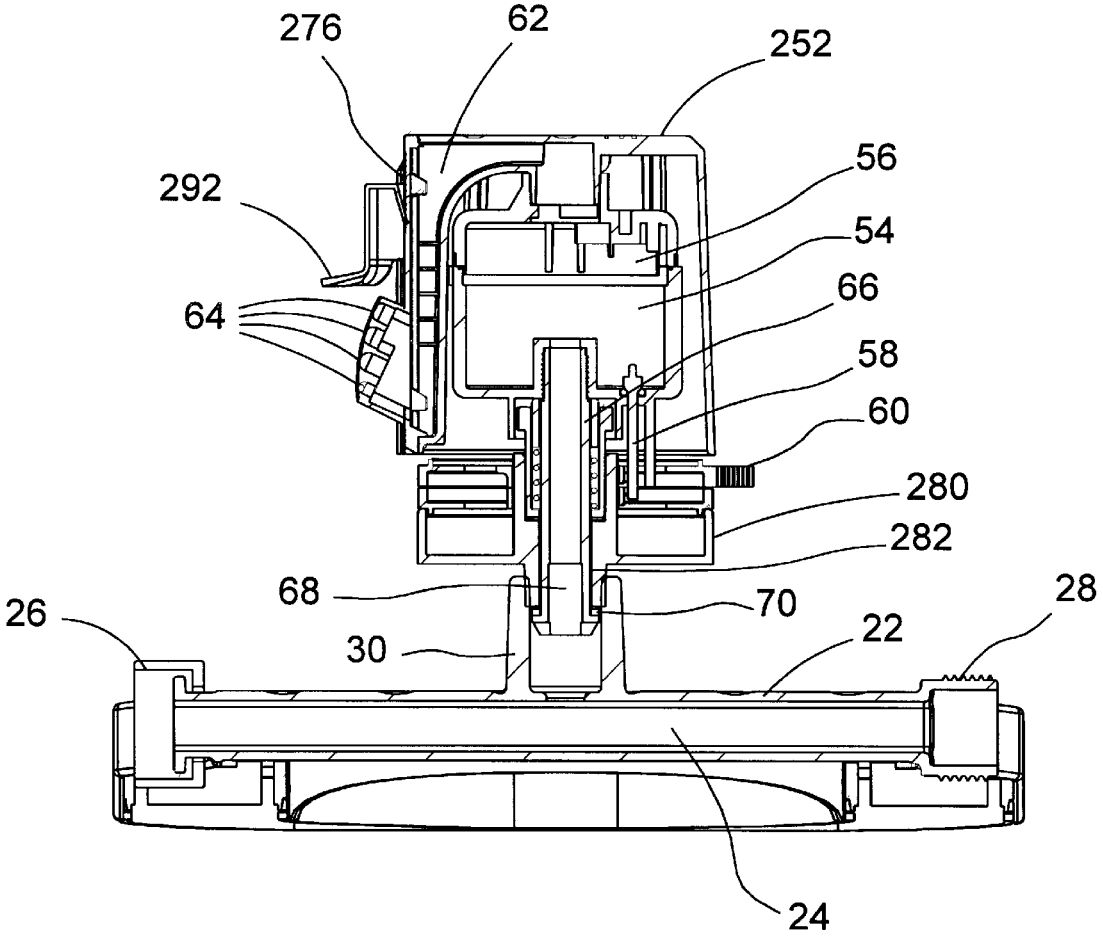
FIG. 23 is a cross-section view of the sprinkler of FIGS. 21–22 along the lines 23—23 of FIG. 22.

With reference to the Figures, FIGS. 1–14 show the preferred sprinkler 10, having a base 20 and a sprinkler head assembly 40. FIGS. 15-20 show the sled base 20 and FIGS. 21–23 show sled base 20 having an alternative sprinkler head assembly 240 thereon.

Sled base 20 is shown in detail in FIGS. 15–20 and with sprinkler heads connected thereto in the other Figures. Sled base 20 has a main body 22 with an inverted T-shaped water channel 24 thereacross. Channel 24 has three openings, horizontal female hose connector 26, horizontal male hose connector 28, and vertical sprinkler head assembly connector 30. A water hose from a water supply has the male hose end threaded into connector 26. Connector 28 can have a female hose end threaded thereon to feed water to another sprinkler or connector 28 can be capped. Connector 30 receives a sprinkler head assembly, explained in more detail hereinafter. Typically, connector 30 is a female connector with internal threads.

Figure 19:
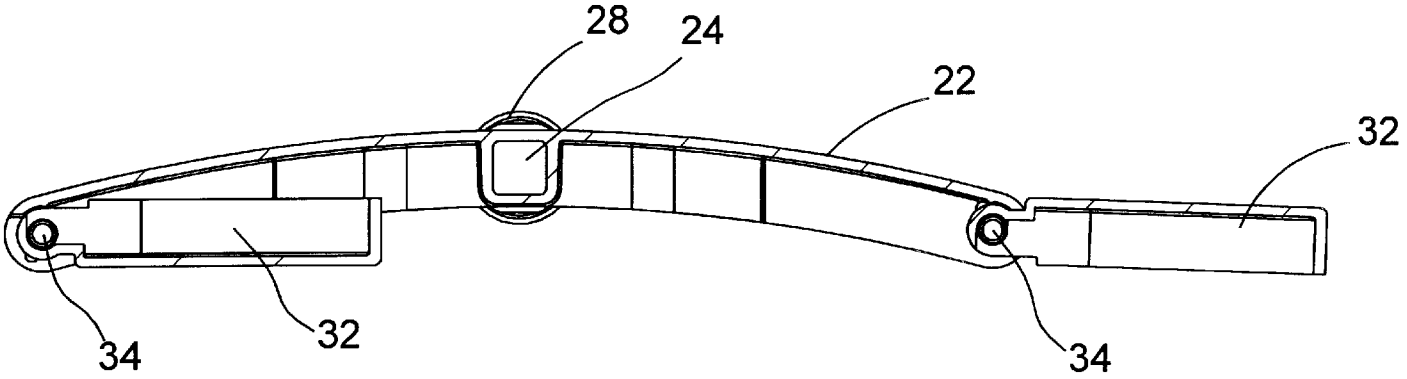
FIG. 19 is a cross-section view of the sled base along the lines 19—19 of FIG. 16.
Figure 20:
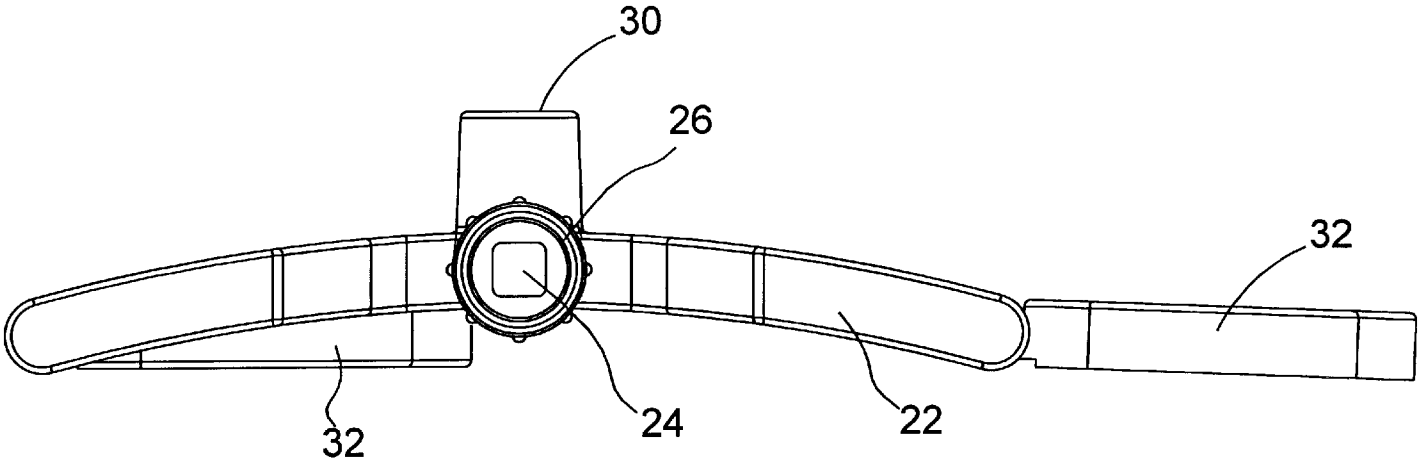
FIG. 20 is a front view of the sled base along the lines 20—20 of FIG. 16.

A pair of wings or foot pads 32 are pivotally connected at opposed ends of main body 22 using pivotal connection means 34. For example, as best seen in FIG. 19, wings 32 can be connected in a way similar to the way in which a watch band is attached to a watch, a pin can pass through a bore in wing 32 and be received by opposed receptacles in body 22. Instead of receptacles, through bores could pass through body 22 and a pin could be inserted through the bores and the bore in wing 32. The pin could be a bolt and nut combination or the like. Pads 32 permit compact storage when folded under main body 22, shown by left pad 32 in FIG. 20, and permit enhanced ground contact and more stability when unfolded, shown in FIG. 22.

prior art rotating sprinklers have the water flow up through the sprinkler head and out the top of the sprinkler. The sprinkler head is rotating about an axis. The force of the water coming out of the top of the sprinkler and spraying to the side causes the sprinkler to become unstable and possibly turn over. While sled base 22 provides a more stable footprint, sprinkler head assemblies 40 of FIGS. 1–14 and 240 of FIGS. 21–23 include a water channel 62 which takes the water closer to the ground to lower the water exit points out jets 64 to make the sprinkler more stable.

Figure 1:
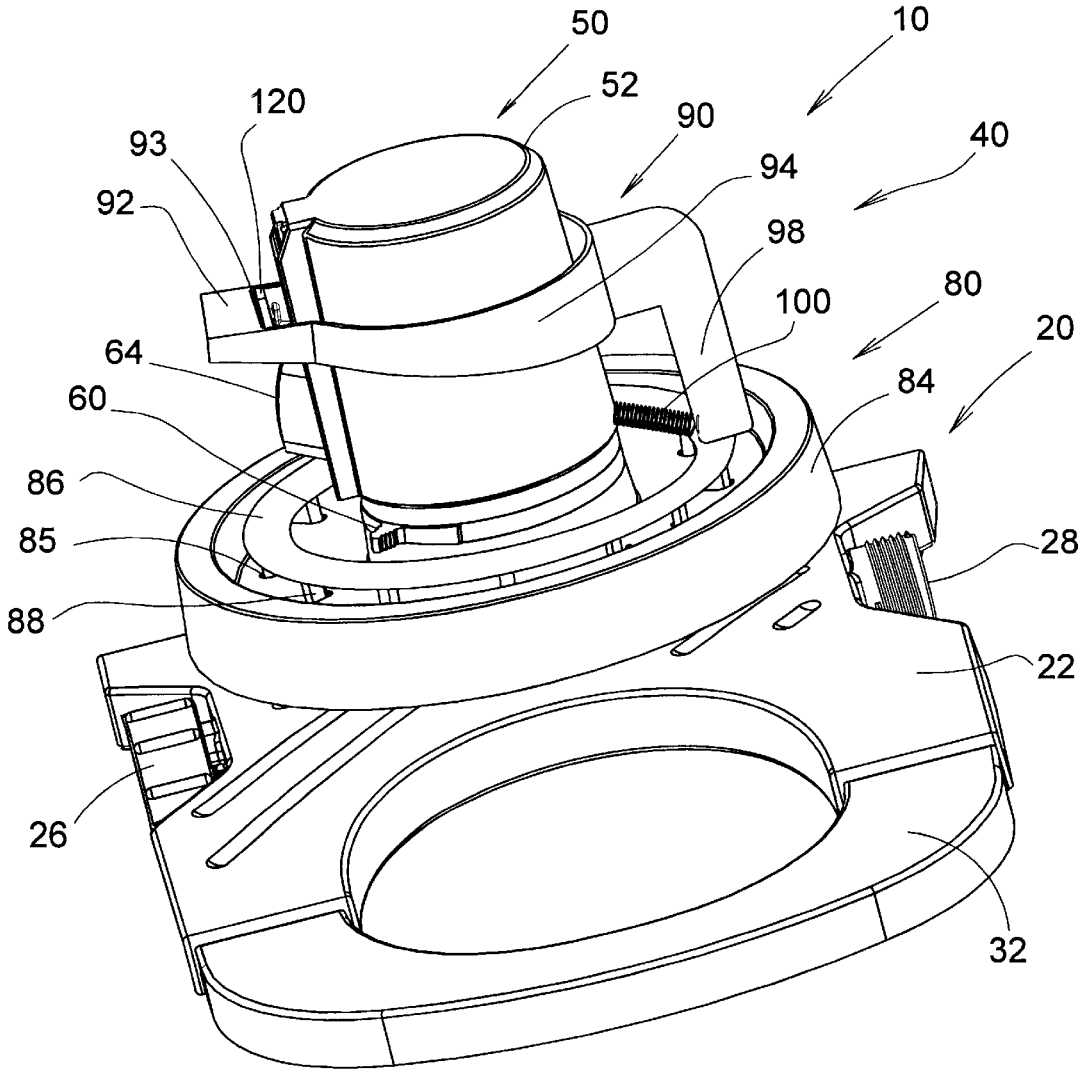
FIG. 1 is a perspective view of a preferred sprinkler of the instant invention, the circular cam surface being raised.
Figure 2:
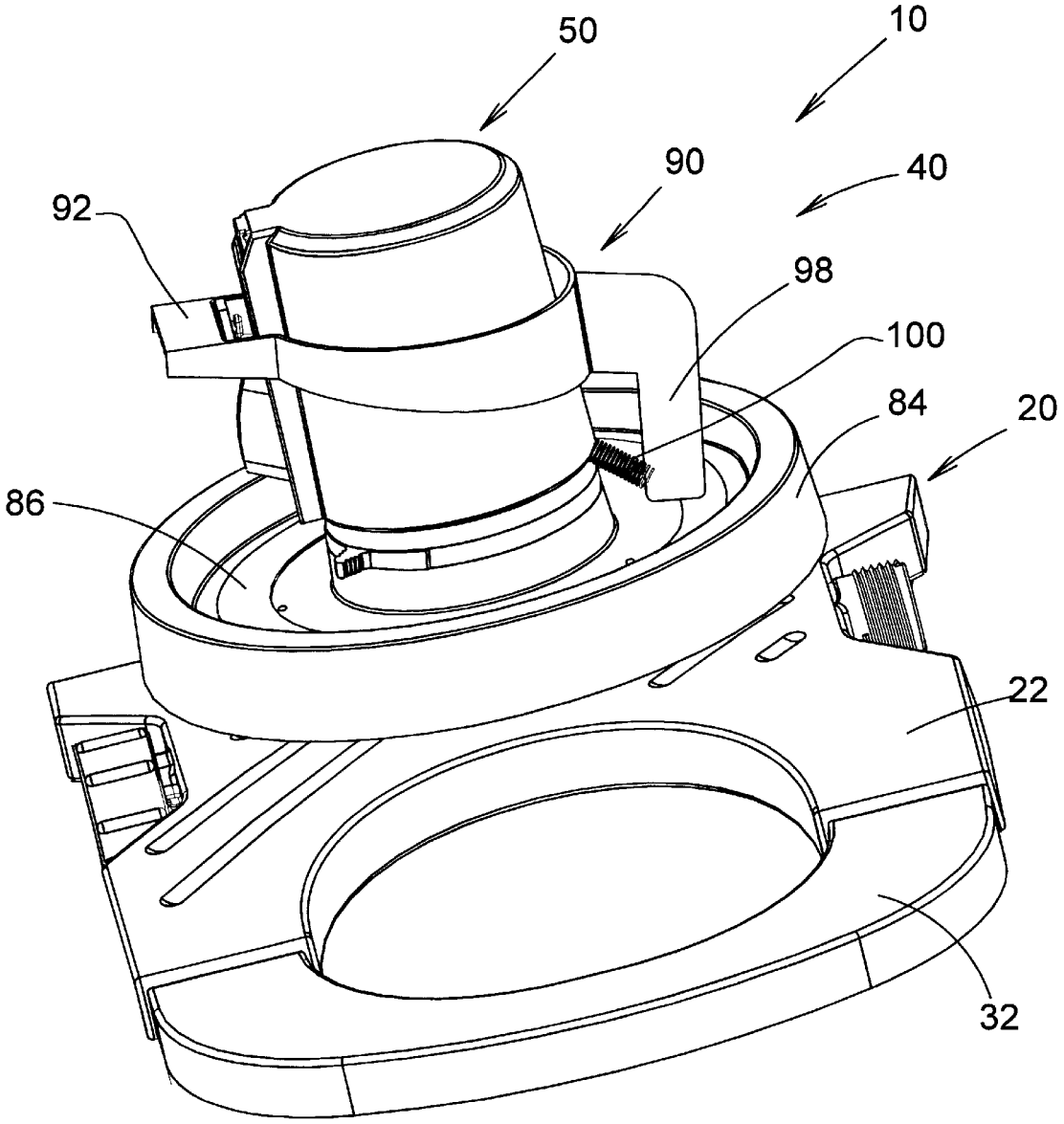
FIG. 2 is a perspective view of a preferred sprinkler of the instant invention, the circular cam surface being lowered.
Figure 3:
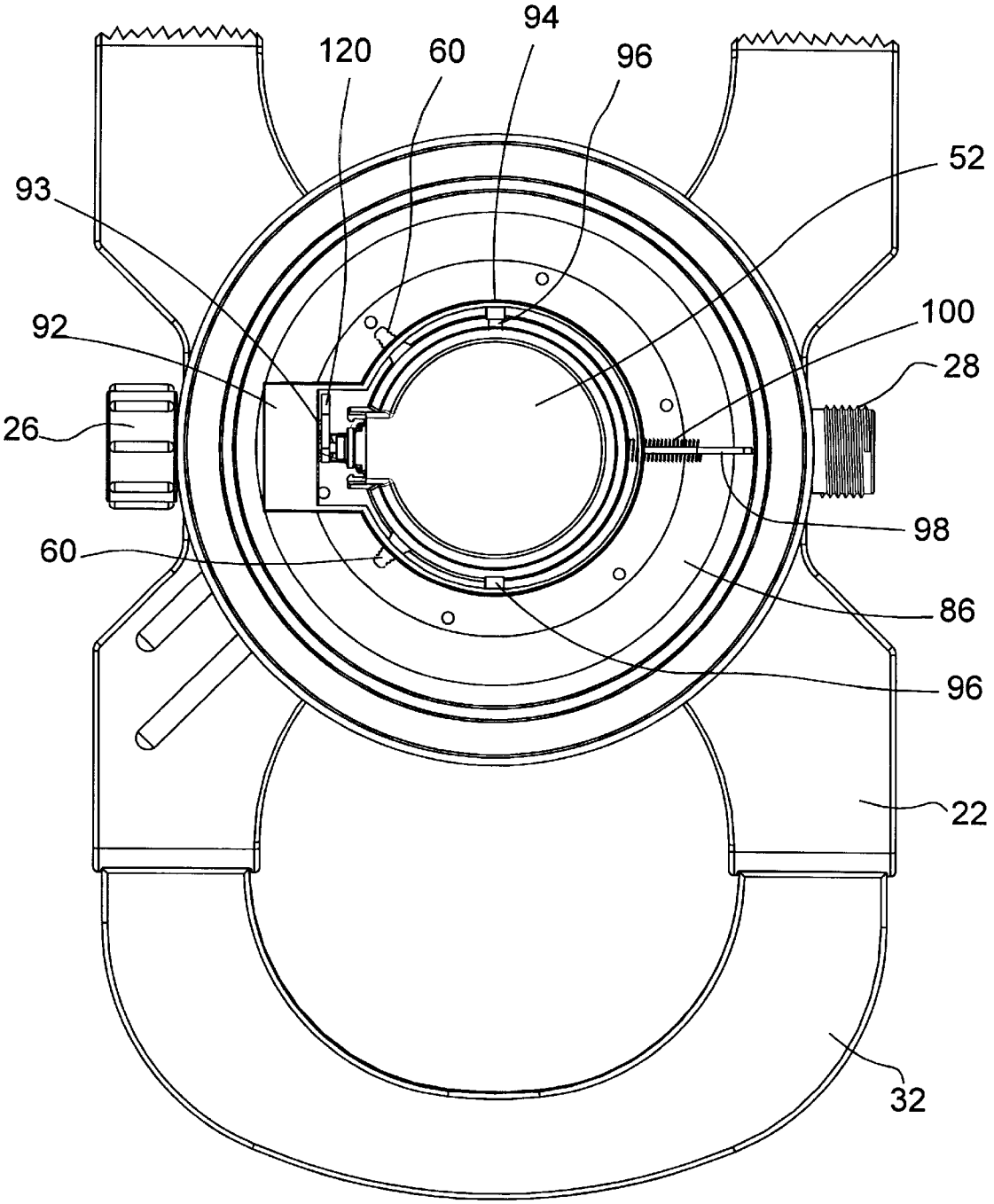
FIG. 3 is a top view of a portion of the sprinkler of FIG. 1.
Figure 4:
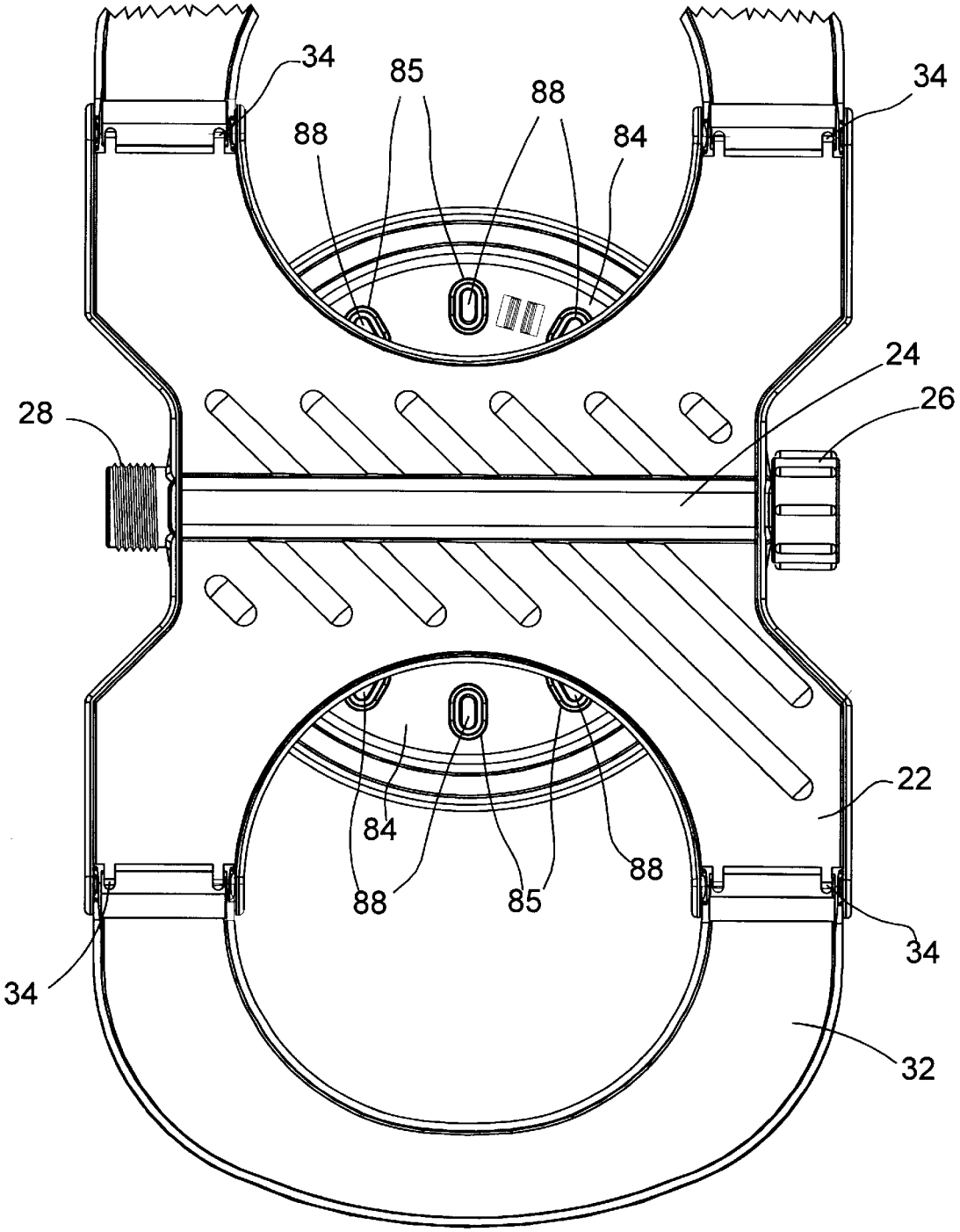
FIG. 4 is a bottom view of a portion of the sprinkler of FIG. 1.
Figure 5:
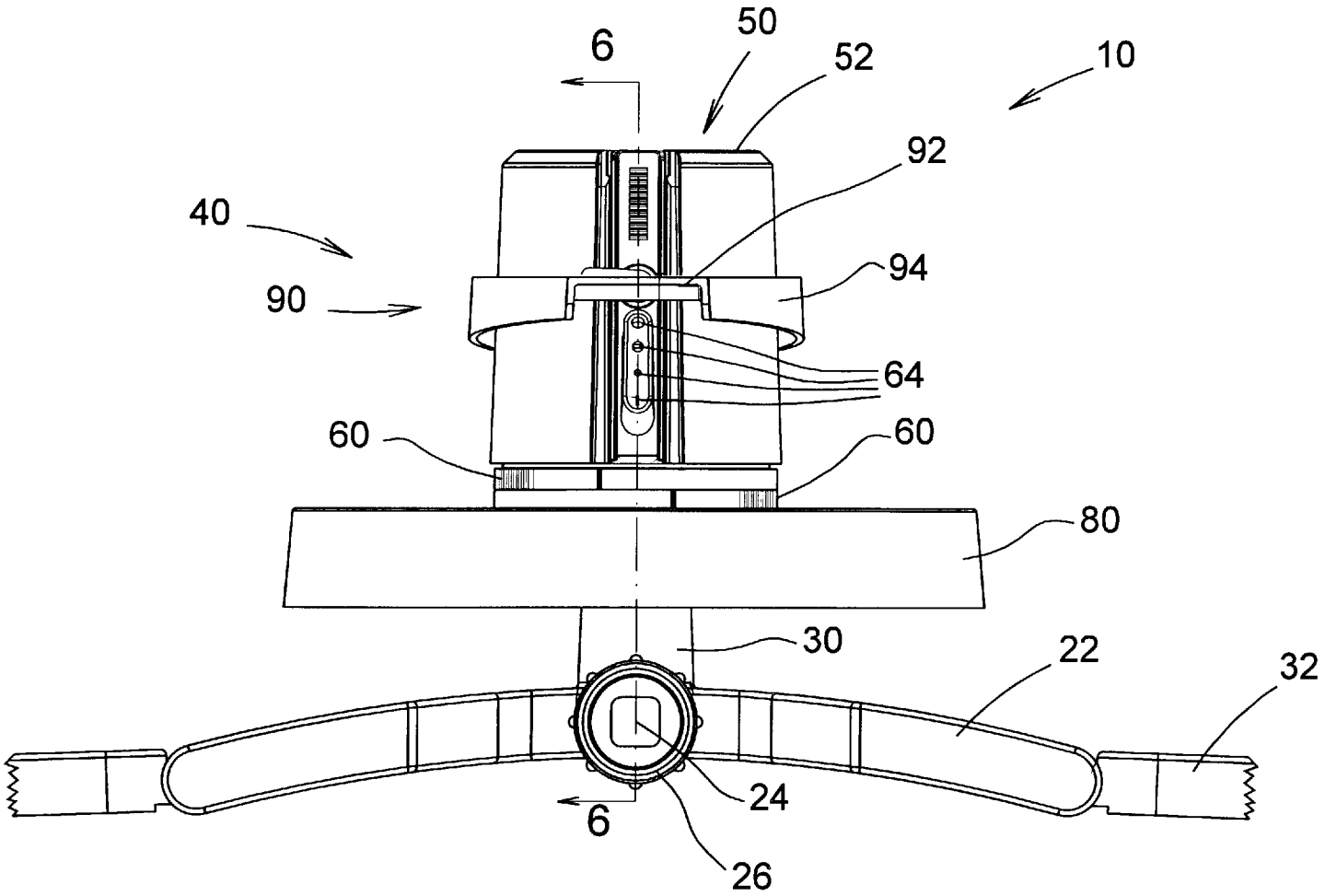
FIG. 5 is a front view of a portion of the sprinkler of FIG. 1.
Figure 6:
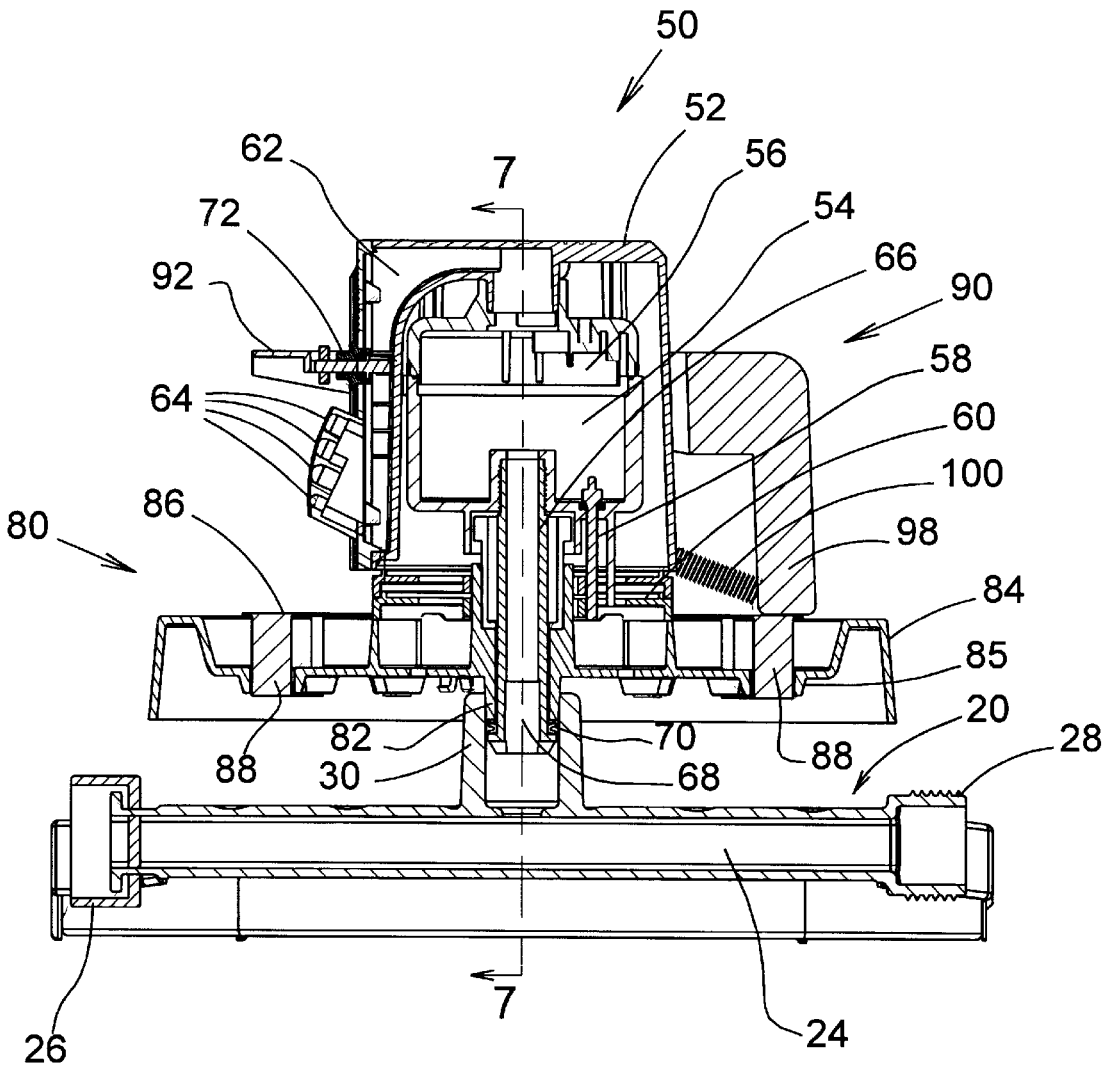
FIG. 6 is a cross-sectional view of the sprinkler of FIG. 1 along the lines 6—6 of FIG. 5.
Figure 7:
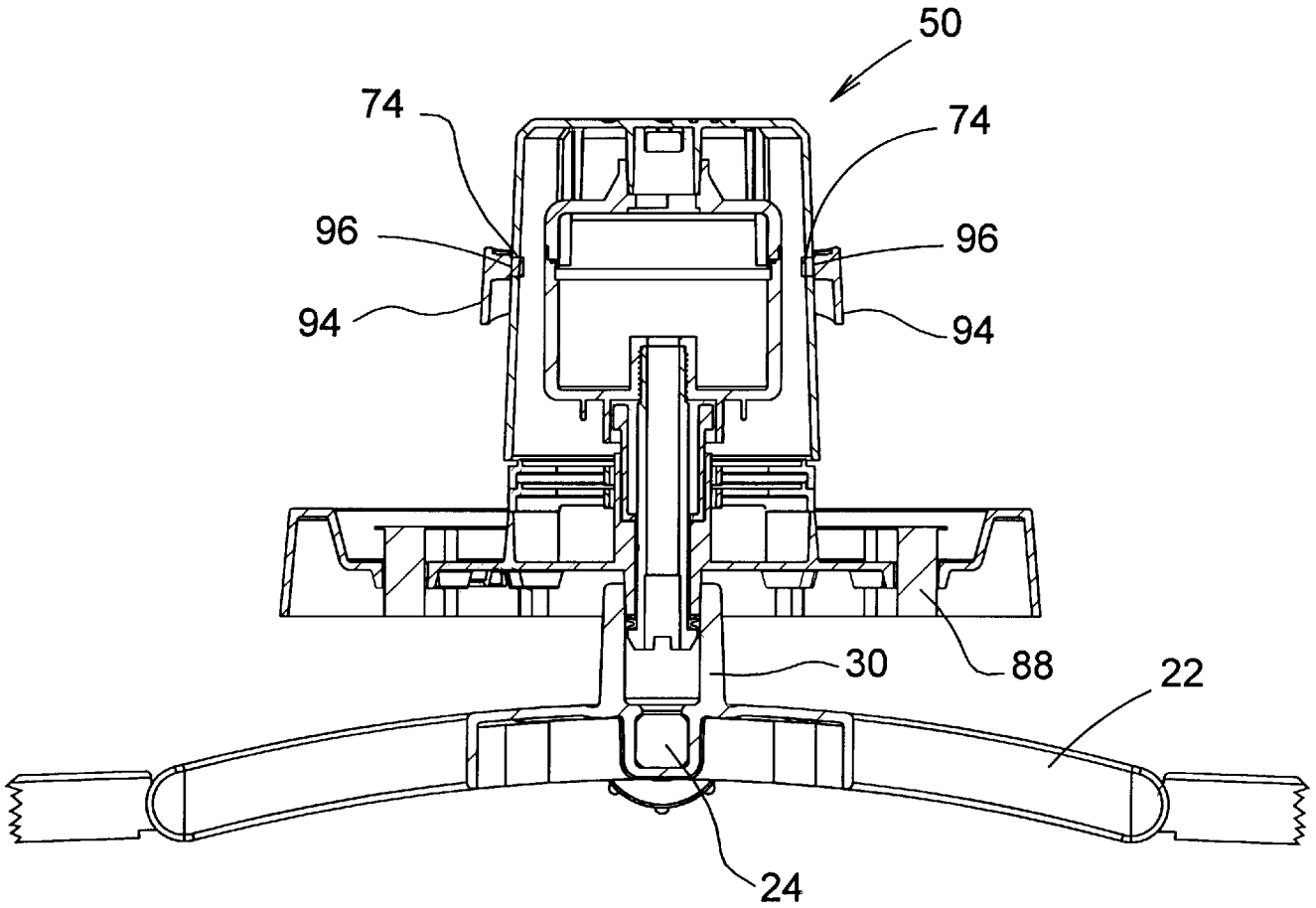
FIG. 7 is a cross-sectional view of the sprinkler of FIG. 1 along the lines 6—6 of FIG. 6.

With particular reference to FIG. 6 and general reference to FIGS. 1–14, sprinkler 10 has sprinkler head assembly 40 connected into base 20's sprinkler head assembly connector 30 by threading portion 82 of body base assembly 80 thereinto. Center shaft 66 extends further into connector 30 than threaded portion 82 and an o-ring seal 70 resides therebetween. Shaft 66 has a water channel 68 therethrough, channel 68 being an extension of water channel 24, providing water into water motor 54. At its top end, shaft 66 is threadably received by water motor 54 and rotates with motor 54 and sprinkler head body 50.

Sprinkler head assembly 40 has a sprinkler head body 50 with outer casing 52. Water motor 54 therein is a standard water motor having a water wheel 56 which drives a gear to rotate the sprinkler. The rotational direction of sprinkler head assembly 40 is controlled by direction switch 58. Adjustment means 60 provides 0 to 360 degree adjustment. For example, if adjustment means 60 is set for 360 degree rotation, head 40 will rotate in one direction for 360 degrees and then switch 58 causes head 40 to reverse direction and rotate the other direction for 360 degrees. Switch 58 reverses direction and the process repeats.

Water passing through motor 54 and wheel 56 exits at the top portion of the sprinkler head body 50. Water channel 62 provides a channel from the top toward the base of body 50. This permits the plurality of vertically aligned jets 64 to be located closer to the ground. Therefore, the force of the water exiting the jets 64 is less likely to cause the sprinkler to turn over. As is seen in FIG. 5, the jets 64 decrease in aperture from top to bottom. This is because the top jet sprays further from the sprinkler and the bottom jet sprays the closest to the sprinkler. As area to be covered is a function of area, pi times radius squared, the aperture sizes are based upon this as well.

As will be explained hereinafter, sprinkler 10 of the preferred embodiment includes means for adjusting the water flow to jets 64. To permit this, a bore 72 passes from the casing 52 into channel 62. Casing 52 has a pair of opposed deflector assembly receiving bores 74, shown in FIG. 7 which receive a deflector assembly 90, which may or may not include water flow adjusting means.

Sprinkler 10's body base assembly 80 has a track receiving base 84 having a plurality of bores 85 therein, bores 85 being equally spaced about base 84, for example, every 30 degrees using threaded portion 82 as a center point. A circular track or cam 86 having a plurality of vertical adjusters 88 extending downward therefrom is received by bores 85, one adjuster 88 per bore 85. Assuming 12 adjusters 88, each adjuster can be individually positioned from its uppermost position of FIG. 1 to its lowermost position of FIG. 2, thereby permitting track 86 to be formed into a desired "roller coaster" shape.

Figure 8:
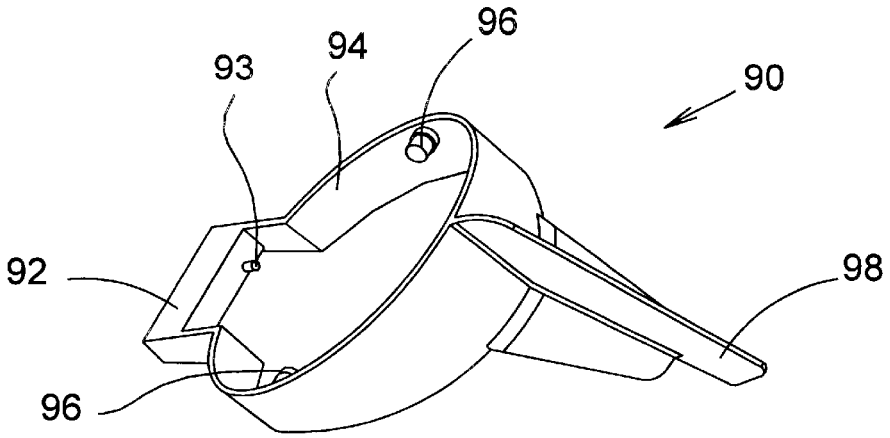
FIG. 8 is a perspective view of the deflector assembly of the sprinkler of FIG. 1.

Deflector assembly 90, seen in FIG. 8, has a deflector 92, a circular portion 94 having opposed pivot pins 96 extending inwardly toward each other, and a track engaging portion or cam follower 98. With pivot pins 96 received by bores 74 of head body 50, seen in FIG. 7, cam follower 98 follows track 86. When track 86 is at its lowermost position, follower 98 is at its lowest position and deflector 92 is at its highest position, just out of the water stream exiting jets 64. As track 86 elevates toward its highest position, cam follower 98 moves toward its highest position, pins 96 pivot in bores 74 and deflector 92 tilts downward into the water stream exiting jets 64 thereby limiting the maximum spray distance.

The track 86 and deflector assembly 90 described so far do not include water flow adjustment means. Sprinkler 10 has a plurality of vertical jets 64. Deflector 92 moves downward to adjust the maximum spray distance by impeding the spray out of the topmost jet 64. If the water flow to all jets 64 can be reduced, the total spray pattern is adjusted, not just the outermost portion. Therefore, sprinkler 10 includes means for adjusting water flow to the jets 64, the adjustment means being linked to movement of the deflector assembly 90.

Figure 9:
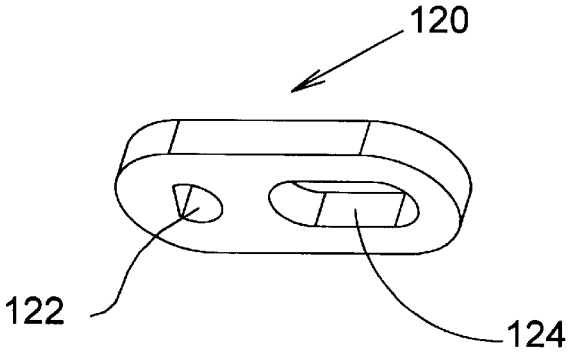
FIG. 9 is an enlarged perspective view of the deflector/adjuster connector of the sprinkler of FIG. 1.
Figure 10:
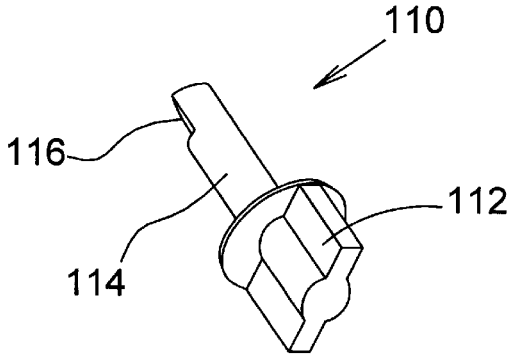
FIG. 10 is an enlarged perspective view of the water flow adjuster of the sprinkler of FIG. 1.
Figure 11:
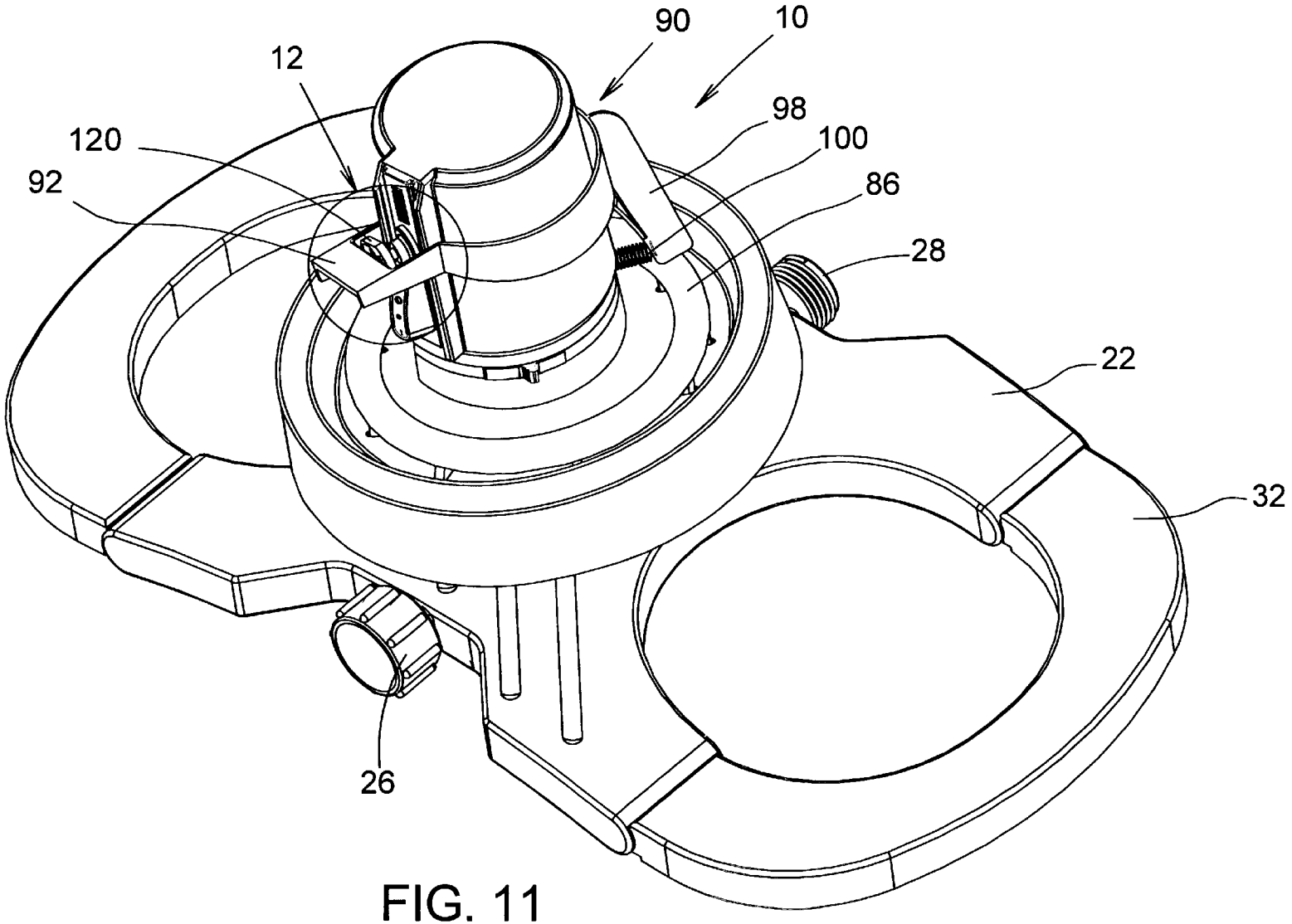
FIG. 11 is an angled perspective view of the sprinkler of FIG. 1 identifying the deflector, water flow adjuster, and connector portion.
Figure 12:
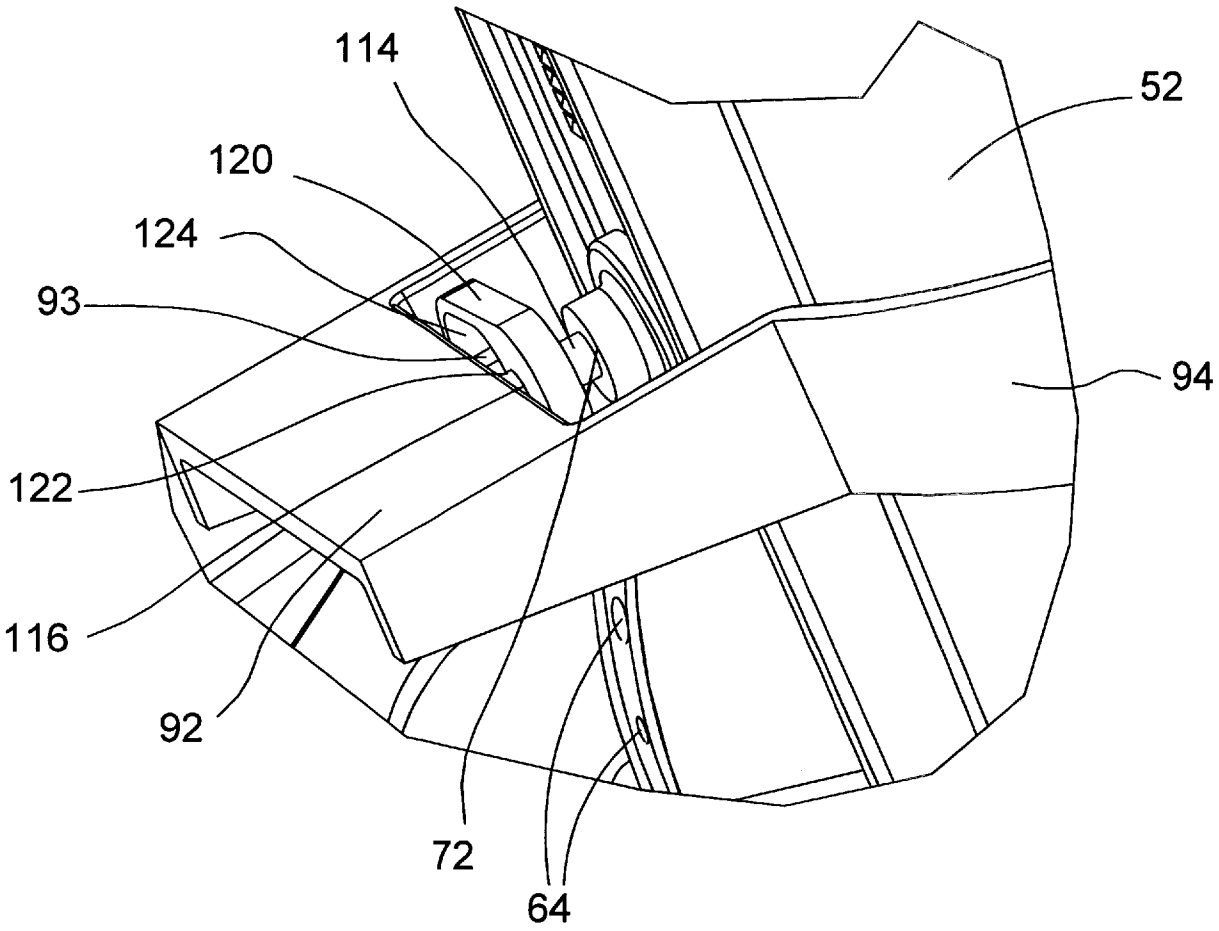
FIG. 12 is an enlarged perspective view of the deflector, water flow adjuster, and connector portion identified by the circle 12 in FIG. 11.
Figure 13:
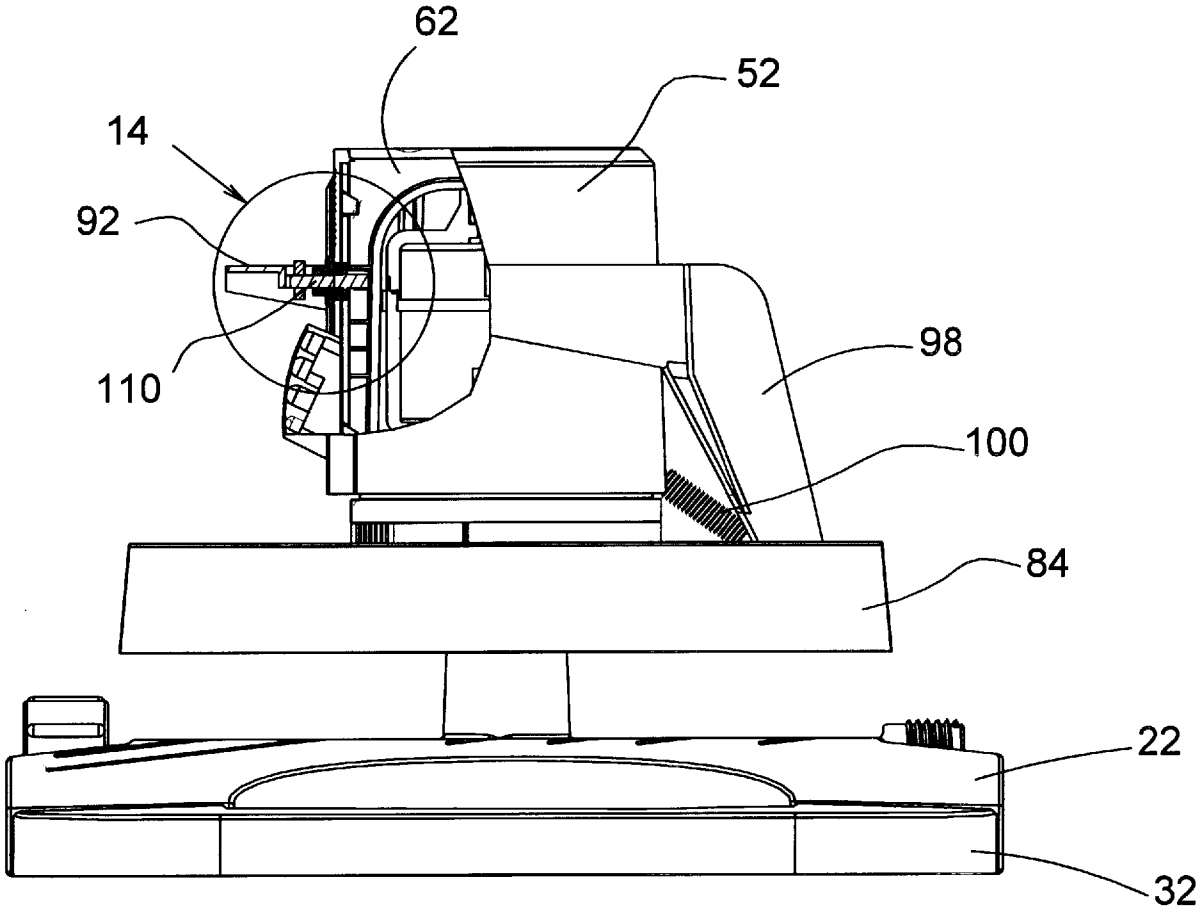
FIG. 13 is a side view with portions cut away of the sprinkler of FIG. 1 identifying the deflector, water flow adjuster, and connector portion.
Figure 14:
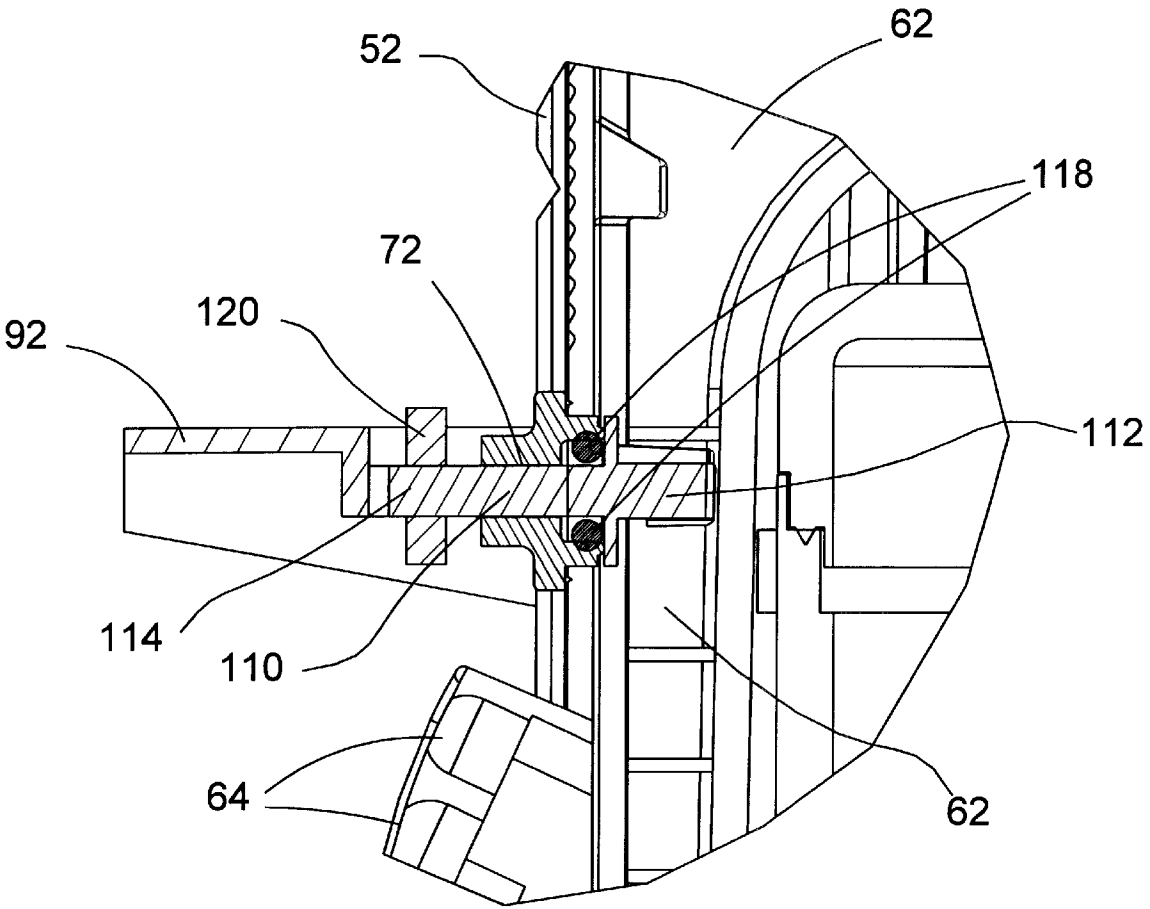
FIG. 14 is an enlarged side view of the deflector, water flow adjuster, and connector portion identified by the circle 14 in FIG. 13.
Figure 15:
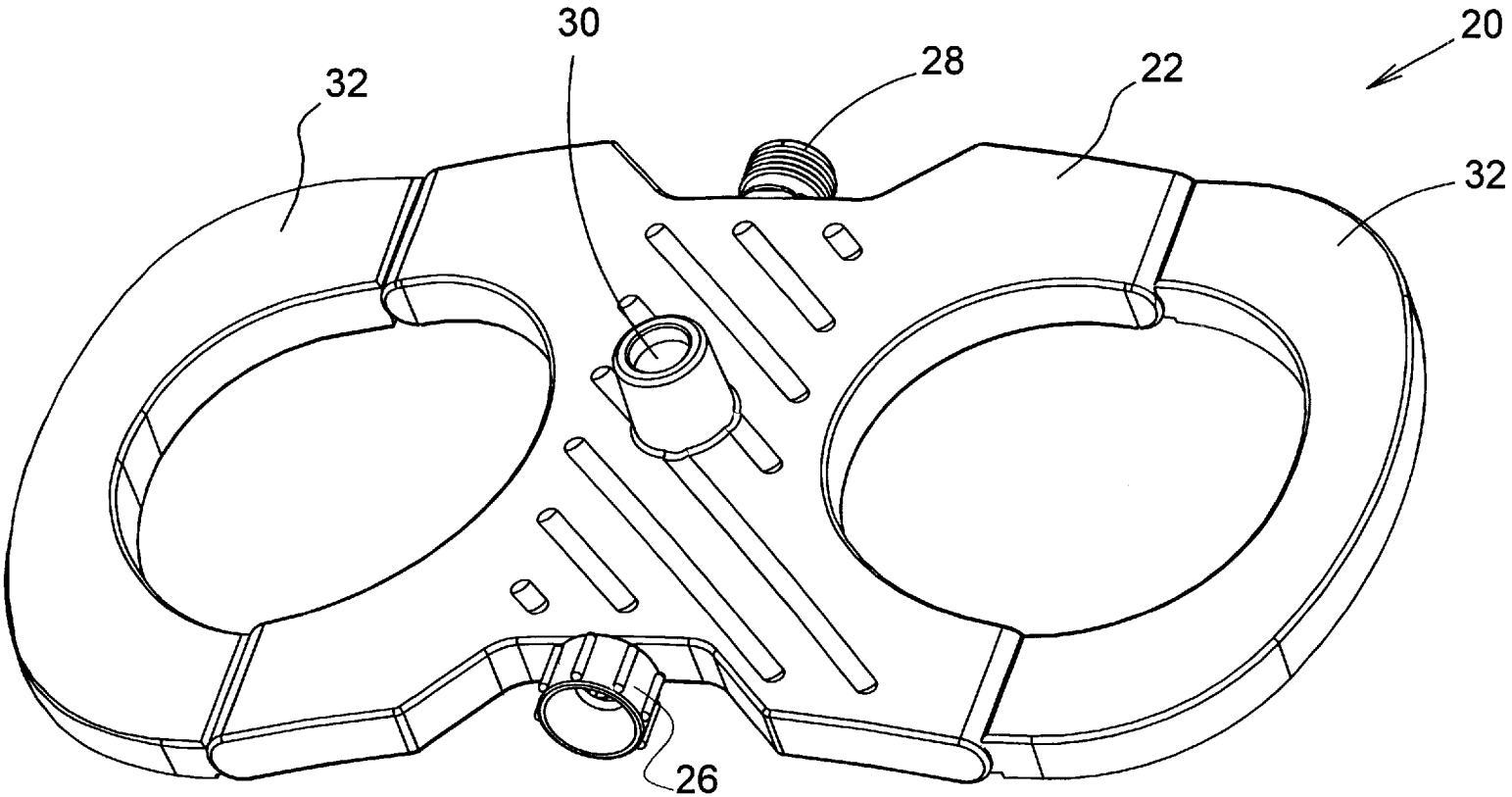
FIG. 15 is a perspective view of the sled base without the sprinkler head assembly.
Figure 16:
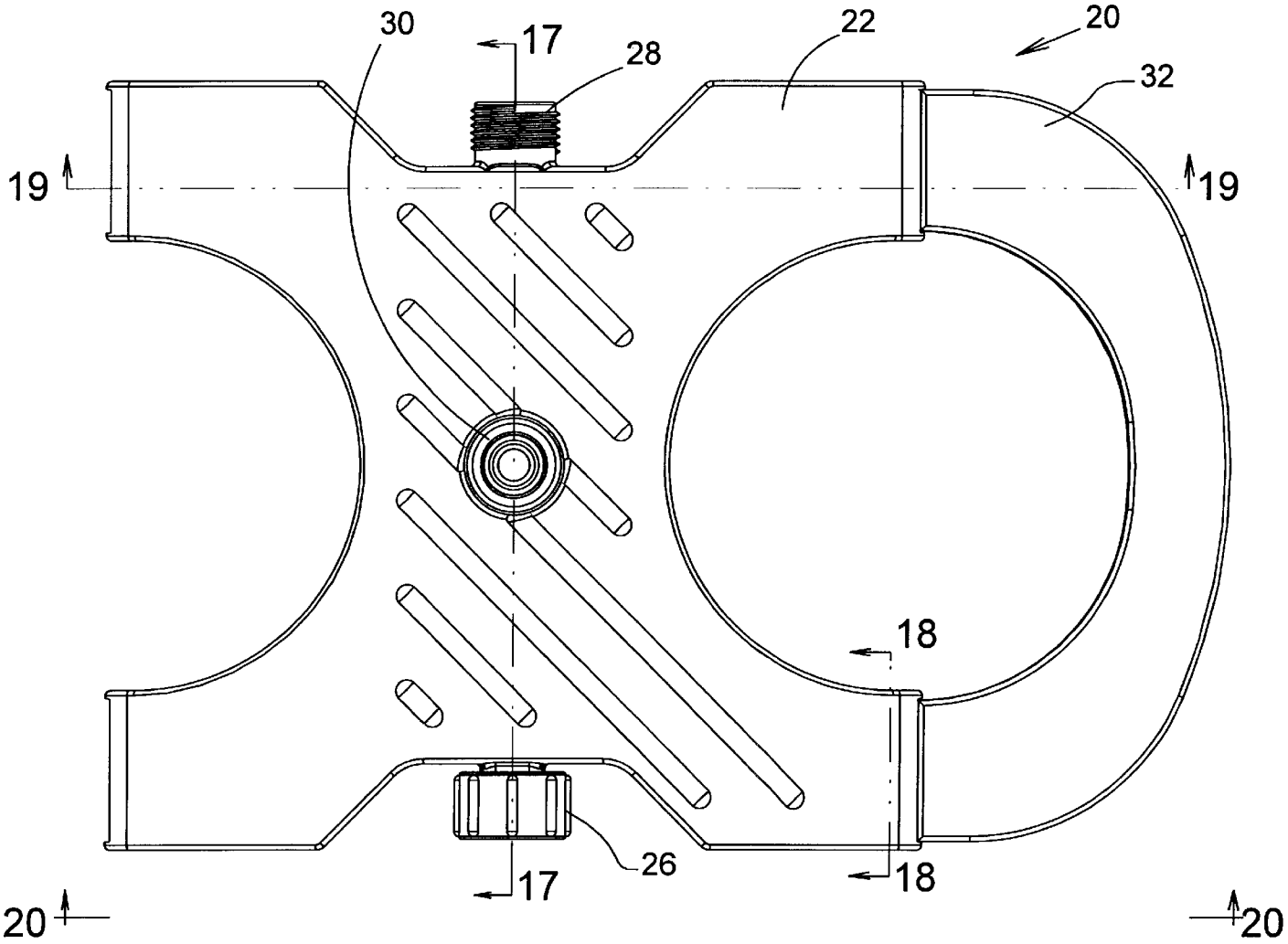
FIG. 16 is a top view of the sled base, the base having the left wing folded under the main body and the right wing extended.
Figure 18:
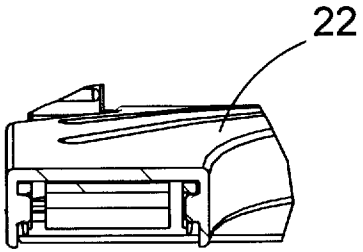
FIG. 18 is a cross-section view of a portion of the main body of the sled base along the lines 18—18 of FIG. 16.
Figure 17:
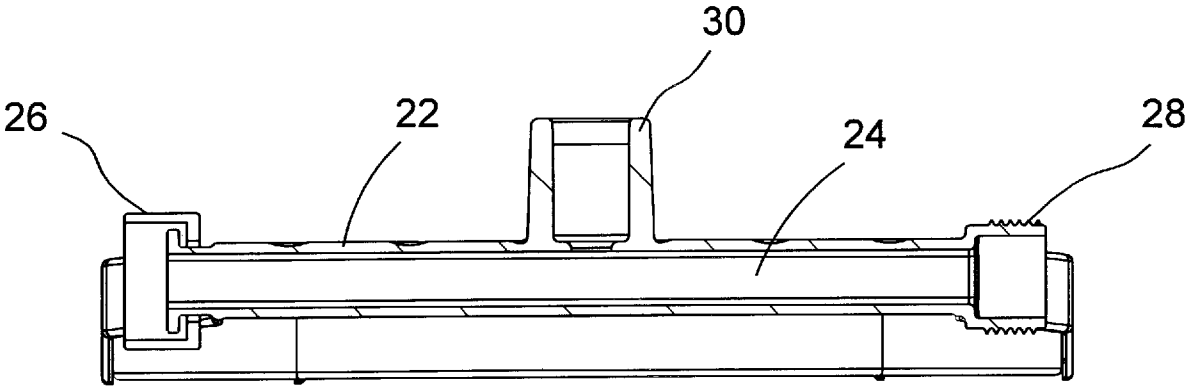
FIG. 17 is a cross-section view of the sled base along the lines 17—17 of FIG. 16.

With particular reference to FIGS. 8–14, deflector assembly is shown having an inward directed pin 93 on the inner portion of deflector 92. A positive return spring 100 is connected between cam follower 98 and outer casing 52 to ensure cam follower 98 follows track 86 and doesn't "float" above the track 86 when the track dips downward. As best seen in FIGS. 10 and 14, a water flow adjuster 110, having a paddle 112, a shaft 114, and a notched end 116 is received within bore 72, wherein paddle 112 is within water channel 62. An o-ring 118 provides a seal between channel 62 and shaft 114 through bore 72. As best seen in FIGS. 9 and 14, a deflector/adjuster connector 120 has a notched end receiving portion 122, shaped like end 116 of adjuster 110, and a slotted pin engaging portion 124. Portion 122 and end 116 mate so that connector 120 can cause adjuster 110 to rotate about shaft 114. This rotation causes paddle 112 to rotate within channel 62, thereby controlling the flow of water to the plurality of jets 64. With portion 124 receiving pin 93 of deflector assembly 90, the up or down movement of deflector 92, rotating about pivot pins 96 as controlled by cam follower 98 following track 86, causes the rotation of shaft 114 and paddle 112 to respectively increase or decrease the flow of water through channel 62 to jets 64.

FIGS. 21–23 show an alternative embodiment sprinkler 210 having a sprinkler head assembly 240 attached to sled base 20. As with sprinkler 10, sprinkler 210 has the low water channel 62 providing water to four vertical jets 64, but it does not have the track 86 and pivoting deflector assembly 90. Body base assembly 280 simply has a threaded portion 282 which is threadably received into connector 30 of base 20. Outer casing 252 of sprinkler head assembly 240 includes a vertical deflector channel 276 which receives a deflector 292. Deflector 292 can be manually moved up or down within channel 276 to set the maximum spray distance.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A sprinkler, comprising:

a. a base having a main body, said main body having means for connecting a sprinkler head assembly thereto, said connecting means being in water flow communication with a main body water channel, said main body having a first side and a second side, said first side being opposed to said second side; said base further having a first wing and a second wing, said first wing being pivotally connected to said first side and said second wing being pivotally connected to said second side, where said first wing and said second wing can be pivoted between a first orientation folded underneath said main body for storage and a second orientation extending outward from said main body in a coplanar relationship for operational use; and b. a sprinkler head assembly, said sprinkler head assembly being connected to said means for connecting a sprinkler head assembly thereto and in water flow communication therewith, said sprinkler head assembly including means for rotating said sprinkler head assembly, said rotating means having a top water exit therefrom, said sprinkler head assembly having at least one water jet, said at least one water jet being at a location vertically below said top water exit, said at least one water jet and said top water exit having a low water channel therebetween.

2. The sprinkler of claim 1, where said at least one water jet comprises a plurality of vertically aligned water jets.

3. The sprinkler of claim 1, further comprising means for controlling maximum spray distance.

4. The sprinkler of claim 3, where said controlling means includes a manually adjustable deflector, said deflector being vertically movable to interfere with a flow of water from said at least one water jet.

5. The sprinkler of claim 3, where said controlling means includes a deflector assembly pivotally connected to said sprinkler head assembly and where said sprinkler includes a track assembly;

a. said track assembly having a track receiving base having a plurality of bores therein, a circular deformable track having a plurality of downward extending adjusters, said downward extending adjusters being received by said plurality of bores and being vertically adjustable therein, said track assembly and said base being in a fixed relationship; and, b. said deflector assembly comprising a deflector and a track engaging portion with a sprinkler head pivotal connector therebetween, said track engaging portion following said track as said sprinkler head assembly rotates; and, where, when said track changes from a vertically low position to a vertically high position, said deflector pivots from a vertically high position to vertically low position to interfere with a flow of water from said at least one water jet.

6. The sprinkler of claim 3, further comprising means for adjusting water flow to said at least one water jet.

7. The sprinkler of claim 5, further comprising means for adjusting water flow to said at least one water jet.

8. The sprinkler of claim 5, where said water flow adjusting means comprises a water flow adjuster and a deflector/adjuster connector;

a. said water flow adjuster having a paddle end and a shaft end connected thereto;

b. said deflector/adjuster connector having a deflector bore and a shaft bore;

c. said deflector having a deflector bore engaging pin;

d. said sprinkler head assembly having an external bore into said low water channel at a location between said top water exit and said at least one water jet;

e. where said paddle end of said adjuster is received in said low water channel, said shaft end of said adjuster extending outward through said external bore and engageably received by said deflector/adjuster connector shaft bore, said deflector bore engaging pin received by said deflector/adjuster connector deflector bore;

f. where, when said deflector pivots from a vertically high position to vertically low position to interfere with a flow of water from said at least one water jet, said deflector bore engaging pin moves said deflector/adjuster connector to cause said water flow adjuster to rotate about said shaft end and cause said paddle to reduce water flow through said low water channel and, thereby, to said at least one water jet.

9. The sprinkler of claim 8, where said at least one water jet comprises a plurality of vertically aligned water jets.

10. A sprinkler head assembly, comprising: means for rotating said sprinkler head assembly, said rotating means having a top water exit therefrom, said sprinkler head assembly having at least one water jet, said at least one water jet being at a location vertically below said top water exit, said at least one water jet and said top water exit having a low water channel therebetween, said sprinkler head assembly having means for controlling maximum spray distance, where said controlling means includes a manually adjustable deflector, said deflector being vertically movable to interfere with a flow of water from said at least one water jet.

11. The sprinkler head assembly of claim 10, further comprising means for adjusting water flow to said at least one water jet.

12. A sprinkler head assembly, comprising: means for rotating said sprinkler head assembly, said rotating means having a top water exit therefrom, said sprinkler head assembly having at least one water jet, said at least one water jet being at a location vertically below said top water exit, said at least one water jet and said top water exit having a low water channel therebetween, said sprinkler head assembly having means for controlling maximum spray distance, where said controlling means includes a deflector assembly pivotally connected to said sprinkler head assembly, where said sprinkler head assembly is rotatably attached to a base, and where said sprinkler head assembly includes a track assembly;

a. said track assembly having a track receiving base having a plurality of bores therein, a circular deformable track having a plurality of downward extending adjusters, said downward extending adjusters being received by said plurality of bores and being vertically adjustable therein, said track assembly and said base being in a fixed relationship; and, b. said deflector assembly comprising a deflector and a track engaging portion with a sprinkler head pivotal connector therebetween, said track engaging portion following said track as said sprinkler head assembly rotates; and, where, when said track changes from a vertically low position to a vertically high position, said deflector pivots from a vertically high position to vertically low position to interfere with a flow of water from said at least one water jet.

13. The sprinkler head assembly of claim 12, further comprising means for adjusting water flow to said at least one water jet.

14. The sprinkler head assembly of claim 12, where said water flow adjusting means comprises a water flow adjuster and a deflector/adjuster connector;

a. said water flow adjuster having a paddle end and a shaft end connected thereto;

b. said deflector/adjuster having a deflector bore and a shaft bore;

c. said deflector having a deflector bore engaging pin;

d. said sprinkler head assembly having an external bore into said low water channel at a location between said top water exit and said at least one water jet;

e. where said paddle end of said adjuster is received in said low water channel, said shaft end of said adjuster extending outward through said external bore and engageably received by said deflector/adjuster shaft bore, said deflector bore engaging pin received by said deflector/adjuster deflector bore;

f. where, when said deflector pivots from a vertically high position to vertically low position to interfere with a flow of water from said at least one water jet, said deflector bore engaging pin moves said deflector/adjuster connector to cause said water flow adjuster to rotate about said shaft end and cause said paddle to reduce water flow through said low water channel and, thereby, to said at least one water jet.

15. The sprinkler head assembly of claim 14, where said at least one water jet comprises a plurality of vertically aligned water jets.

* * * * *